US005941181A

United States Patent [19]

Hornberger et al.

[11] Patent Number: 5,941,181

[45] Date of Patent: Aug. 24, 1999

[54] FOLDING TABLE LEG APPARATUS

[75] Inventors: Tim G. Hornberger, Green Bay; Jon W. Gayhart, Oshkosh, both of Wis.

[73] Assignee: Krueger International, Inc., Green Bay, Wis.

[21] Appl. No.: 08/843,543

[22] Filed: Apr. 18, 1997

[51] Int. Cl.[6] ..... A47B 3/00

[52] U.S. Cl. ..... 108/133; 108/131

[58] Field of Search ..... 108/131, 133, 108/132, 129; 248/188

[56] References Cited

U.S. PATENT DOCUMENTS

| | | | |
|---|---|---|---|
| 2,318,945 | 5/1943 | Johannsen | 108/133 |
| 2,860,940 | 11/1958 | De Saussure | 108/133 |
| 2,882,109 | 4/1959 | Eves et al. | 108/132 |
| 3,554,141 | 1/1971 | Burr | 108/132 |
| 3,769,920 | 11/1973 | Weiss | 108/133 |
| 4,557,200 | 12/1985 | Geschwender | 108/132 |
| 4,658,735 | 4/1987 | Holton | 108/132 X |
| 4,838,180 | 6/1989 | Gutgsell | 108/132 |
| 5,279,233 | 1/1994 | Cox | 108/132 X |
| 5,345,881 | 9/1994 | Loescher | 108/132 |
| 5,483,898 | 1/1996 | Seidl . | |
| 5,528,997 | 6/1996 | Miller | 108/132 X |
| 5,562,051 | 10/1996 | Rizzi | 108/132 |
| 5,606,922 | 3/1997 | Adams et al. | 108/129 |
| 5,673,633 | 10/1997 | Pfister | 108/132 |

FOREIGN PATENT DOCUMENTS

| | | | |
|---|---|---|---|
| 1112267 | 3/1956 | France | 108/132 |

*Primary Examiner*—Jose V. Chen
*Attorney, Agent, or Firm*—Andrus, Sceales, Starke & Sawall

[57] ABSTRACT

A folding table leg apparatus for a table including one or more legs operable between an extended and a folded position. The folding table leg apparatus associated with each of the legs includes a pair of side supports which are connected to the underside of the table top. Each of the side supports includes a receiving notch which receives a cross bar connected to the upper end of the table leg when the table leg is in the extended position. A hinge bracket and a folding plate are connected between the pair of side supports and the table leg to permit the table leg to move between the folded and extended position. The table leg is pivotable about a lower leg pivot axis which is spaced from the upper end of the table leg, such that when the table leg is in the folded position, the distance which the table leg extends from the folding apparatus is less than the entire length of the table leg. The folding apparatus further includes a locking mechanism that secures the cross bar in the receiving notches when the table leg is in the extended position. The locking mechanism includes a pair of locking brackets joined by a connecting rod such that the locking brackets are operatively joined. As the folding table leg moves from the folded position to the extended position, the cross bar interacts with a cam surface on each of the locking brackets to rotate the locking brackets away from the receiving notches thereby allowing the cross bar to be received in the receiving notches formed in the side supports. A torsion spring holds the locking brackets in a locked position to securely hold the cross bar in the receiving notches when the table leg is in its extended position.

22 Claims, 3 Drawing Sheets

FIG. 1
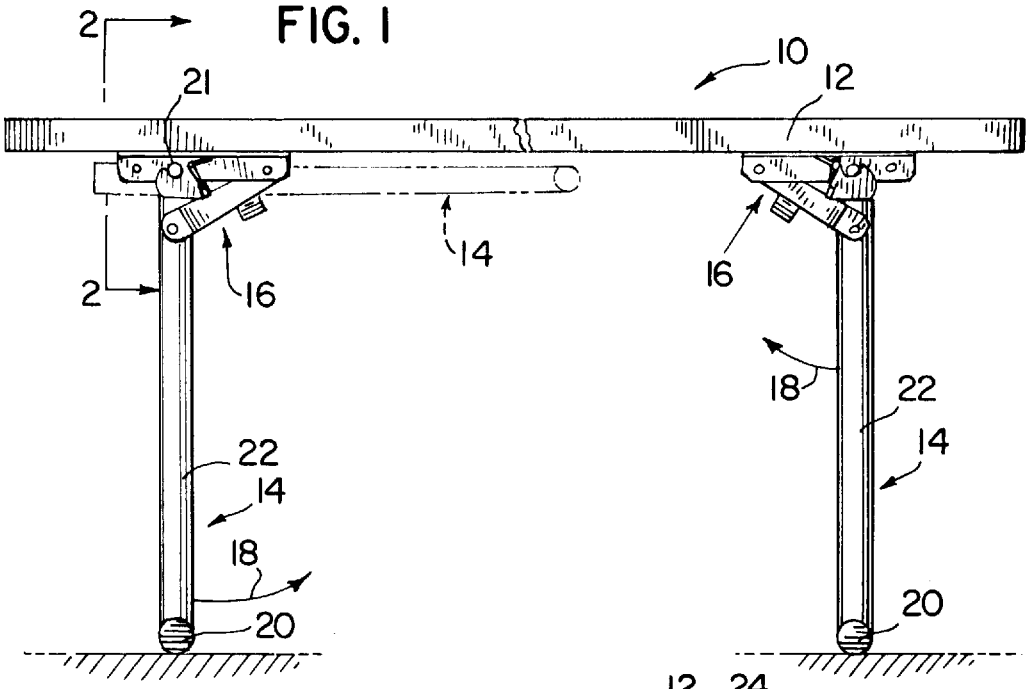
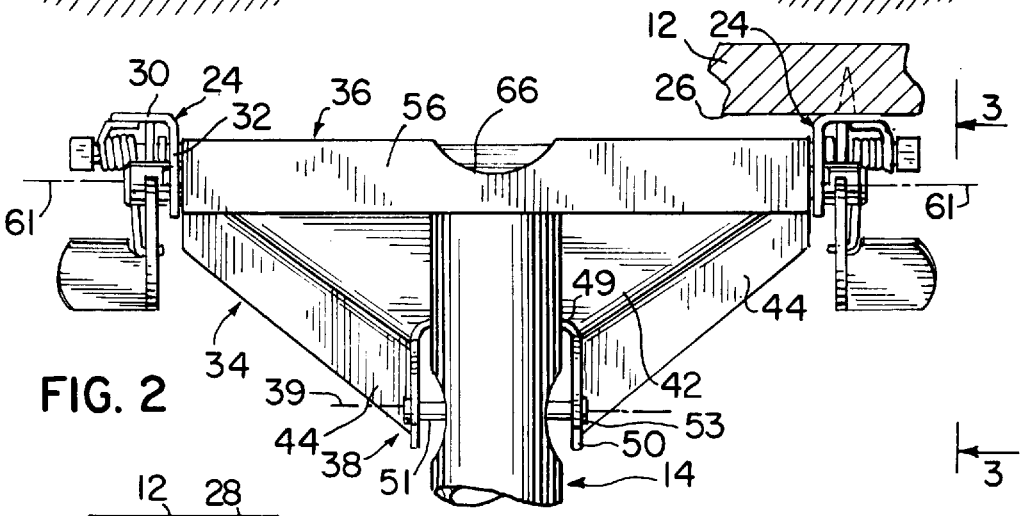
FIG. 2
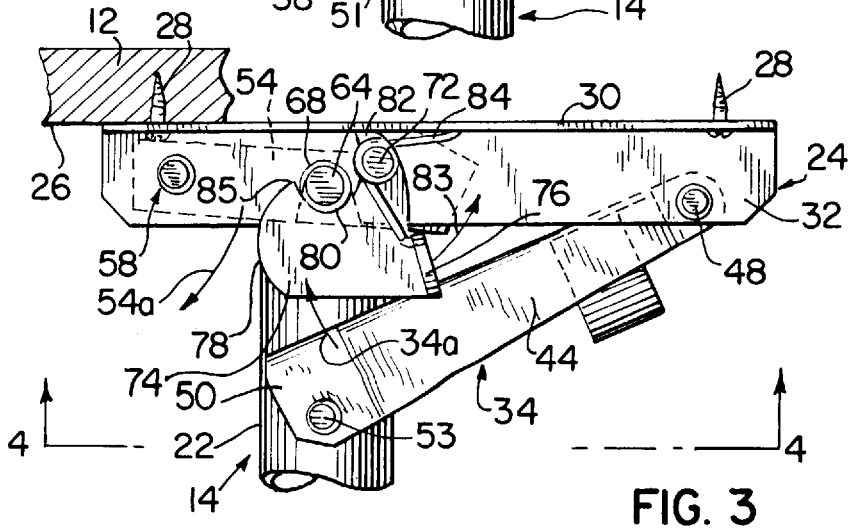
FIG. 3

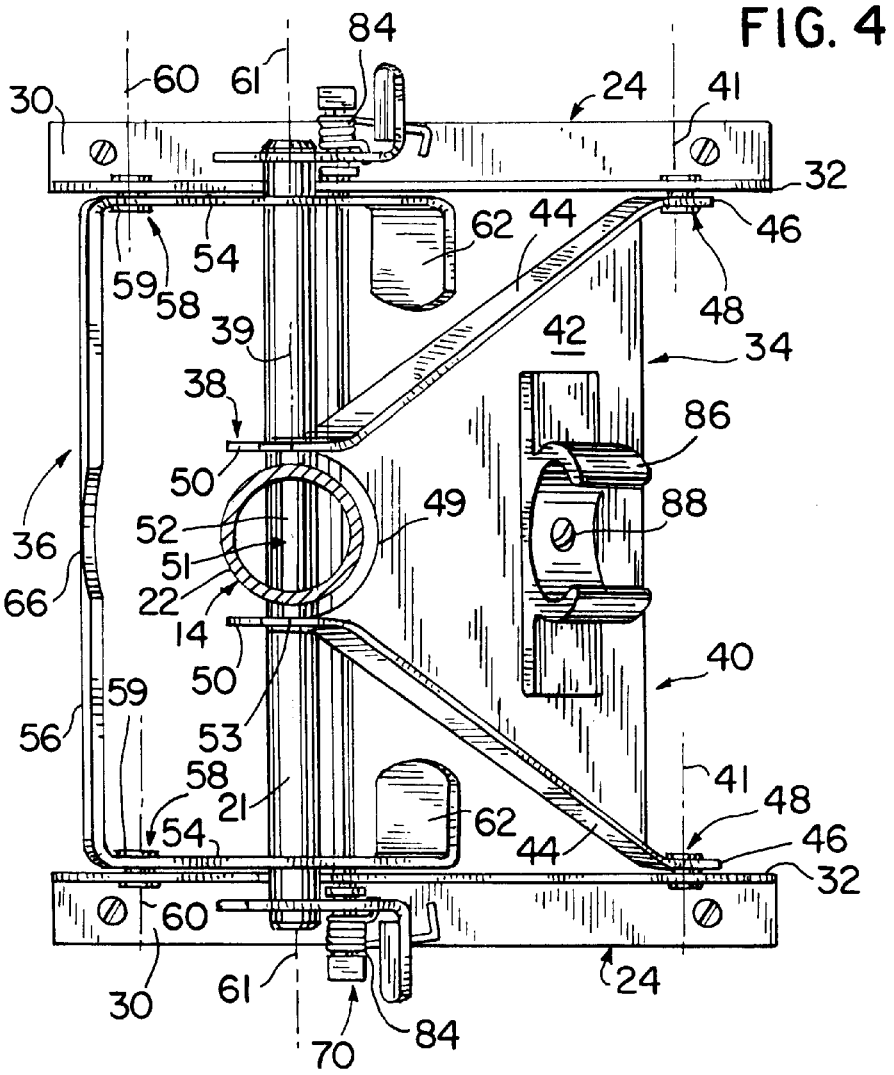
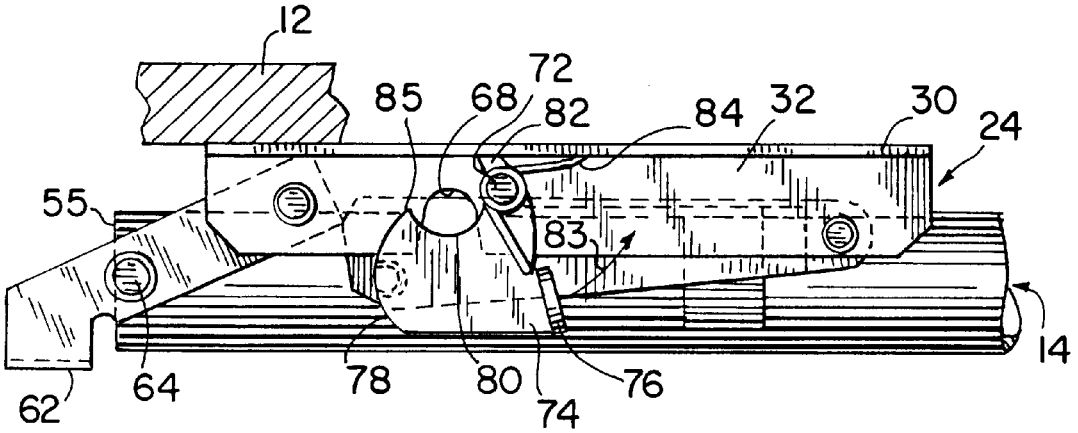
FIG. 5

FIG. 6
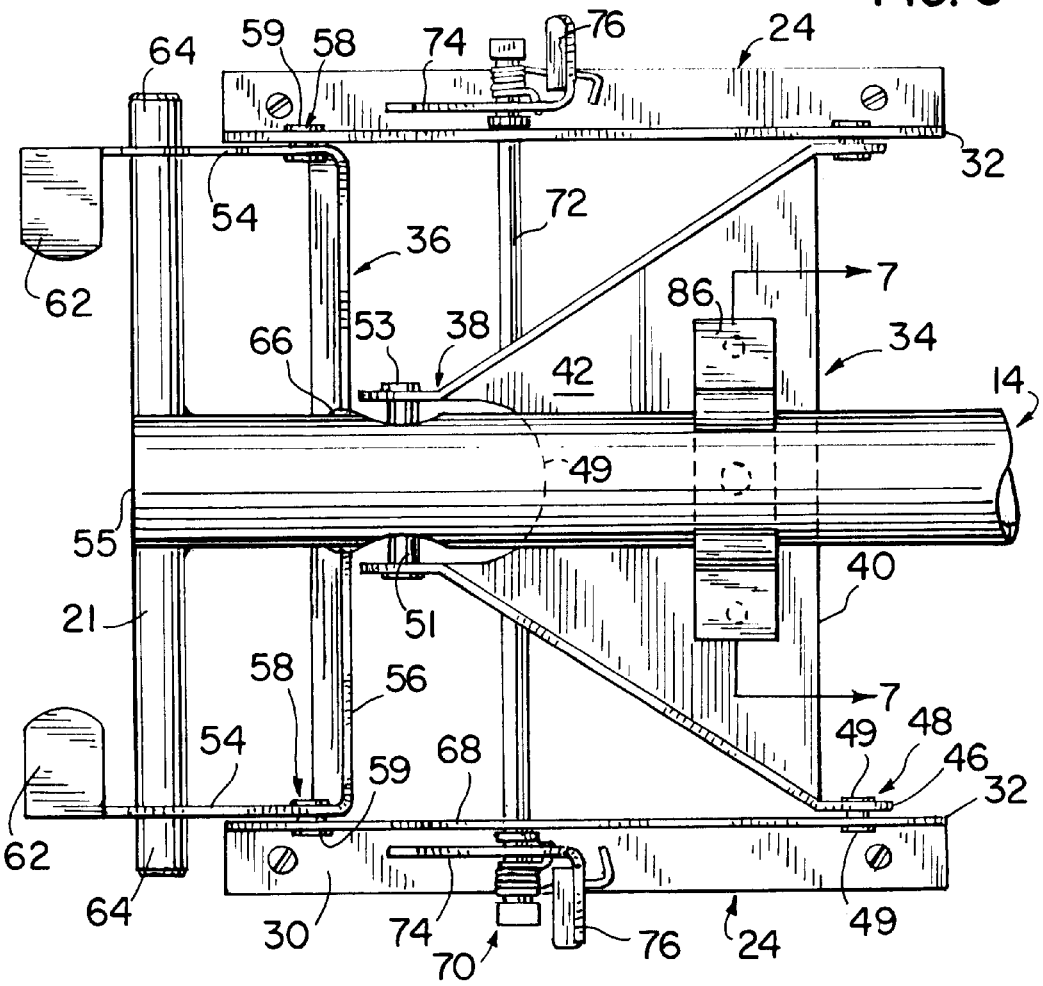
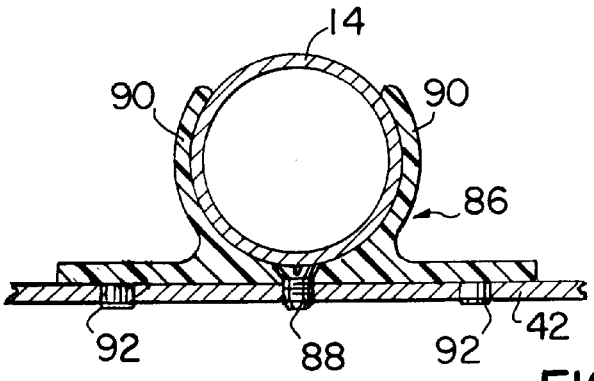
FIG. 7

FOLDING TABLE LEG APPARATUS

BACKGROUND OF THE INVENTION

The invention relates to a mounting and folding apparatus for the legs of a table. More particularly, the invention is a folding apparatus that includes a locking mechanism and a pair of pivoting elements connected between the table leg and a pair of side supports, which allows the table leg to move between a secure extended position for use and a compact folded position for storage.

Folding tables are widely used and derive their primary benefit from the relative ease with which they can be handled and stored when in the folded condition. When in the folded condition, the table minimizes the space needed for storage.

To minimize the amount of space needed for storage, it is desirable to fold the legs flat against the table top to minimize the overall thickness of the space occupied by the table top and the legs. In many conventional folding tables, each of the pair of opposing folding legs includes a pivot connection near or at the end of the leg attached to the table. In this configuration, the folding table legs often overlap each other when in the folded position. The overlapping legs not only damage and scratch each other, but also increase the space needed for storage. To prevent the table legs from overlapping, the legs must be connected to the table top a distance apart equal to or greater than twice the length of each leg. As a result, many folding tables are designed based on the position of the legs in the folded position.

Typically, folding tables include some type of mechanism to prevent the legs from collapsing when they are in the extended position. Many locking mechanisms are often difficult to operate or do not effectively retain the legs in their extended position. Regardless, it is also desirable that the legs lie flat when they are in the folded position to facilitate stacking and storage. A variety of patents have issued related to the folding connection between the table leg and the table top.

Gutgsell U.S. Pat. No. 4,838,180 discloses one configuration for a folding table leg apparatus which includes a single top plate and four projecting side portions extending perpendicular to the top plate. An upper pivot rod passes through the vertical table leg and is pivotally connected to an outer pair of the side portions that define the outer edge of the top plate. A pair of brace links are pivotally connected to the table leg and are secured to an inner pair of side portions mounted inwardly from the outer edge of the top plate. A pair of release brackets are connected to the inner pair of side portions to retain the table leg in its extended position. To release the table leg, each of the pair of the release brackets must be separately depressed in order to allow the table leg to return to its folded position. Therefore, to release the table leg from the extended position in order to move it to the folded position, the user must depress both of the release brackets simultaneously, thus requiring the use of two hands.

BRIEF SUMMARY OF THE INVENTION

It is an object of the present invention to provide a folding table leg apparatus which permits the movement of the table leg between an extended and a folded position for use in connection with a folding table. It is a further object of the invention to provide a locking mechanism for a folding table leg apparatus that is operable by depressing one of a pair of handles located on either side of the folding table leg. It is a further object of the invention to provide a folding table leg apparatus that allows the table leg to pivot about a lower leg pivot axis spaced from the upper end of the table leg, thus reducing the distance the table leg extends from the table leg apparatus when in the folded position.

In accordance with the invention, the folding table leg apparatus includes a pair of parallel side supports which are connected to the underside of the table top. Each of the side supports defines an inner end and an outer end, and consists of a horizontal section mounted to the table top and a vertical section extending perpendicular to the plane of the table top. A cross bar is connected to the upper end of the table leg and extends perpendicular to the table leg.

A folding member in the form of a folding plate is connected between the table leg and the pair of side supports to provide support for the table top. The folding plate defines first and second ends. The folding plate is pivotally connected at its first end to the table leg below the upper end of the leg, such that the pivotal connection of the folding plate to the leg defines a first lower leg pivot axis. The folding plate is pivotally connected at its second end to each of the side supports toward the inner end thereof to define a folding plate pivot axis. With this construction, the table leg is pivotable about the lower leg pivot axis relative to the folding plate when the table leg is moved between its folded and extended positions, and the folding plate is pivotable about the folding plate pivot axis relative to the side supports.

The table leg is also pivotally connected to both of the side supports by a hinge bracket. The hinge bracket consists of a pair of parallel pivot arms and a transverse member extending between the pivot arms. The pivot arms are each pivotally connected to one of the side supports toward the outer end of each side support, for pivoting movement about a hinge bracket pivot axis. Additionally, each of the pivot arms is pivotally connected to the cross bar connected to the upper end of the table leg. In this manner, the table leg is pivotable about a second, upper leg pivot axis defined by the longitudinal axis of the cross bar via the pivoting connection between the cross bar and the pivot arms of the hinge bracket when the leg is moved between its folded and extended positions. The upper and lower leg pivot axes, the folding plate pivot axis and the hinge bracket pivot axis are all substantially parallel to each other.

When the table leg is in the extended position, the cross bar is received in a pair of receiving notches, one of the receiving notches being formed in each of the side supports. Therefore, in the extended position, the cross bar and table leg support the weight of the table top and engagement of the cross bar within the receiving notches prevents the table leg from being moved away from its extended position.

The cross bar is preferably fixed to the upper end of the table leg so as to extend outwardly in opposite directions from the table leg. The lower leg pivot axis defined by the pivoting connection between the table leg and the folding plate is spaced from the upper end of the table leg by the distance defined by the spacing between the cross bar and the connection of the folding plate to the table leg. As the table leg is moved from the extended position to the folded position, the upper end of the table leg moves laterally outward such that in the folded position, only a portion of the table leg extends inwardly from the folding table leg apparatus to reduce the space occupied by the leg when in its folded position.

The folding table leg apparatus of the invention further includes a locking mechanism to securely hold the cross bar in the receiving notches formed in the side supports when the table leg is in its extended position. The locking mechanism of the invention includes a pair of locking brackets, each of which is normally disposed in a locked position to cover the receiving notches on the side supports. Preferably, the locking brackets are interconnected by a connecting rod which extends between the pair of side supports and is pivotally mounted thereto. The locking brackets are movable to an unlocked position away from the receiving notches, and the connecting rod functions to provide synchronous pivoting movement of the locking brackets between their locked and unlocked positions. Preferably, a torsion spring is positioned between each of the locking brackets and the side support, such that the torsion spring biases the locking brackets into the locked position.

When the table leg is moved from its folded position to its extended position, the cross bar contacts a cam surface defined by each of the locking brackets. The interaction between the cross bar and the cam surface causes the locking brackets to rotate relative to the fixed side supports. This rotation of the locking brackets moves the locking brackets away from the locked position, allowing the cross bar to enter the receiving notches. Once the cross bar is contained within the pair of receiving notches, the locking brackets return to their locked position under the force of the torsion springs to maintain the cross bar within the receiving notches.

Each of the locking brackets includes a handle which can be depressed to cause the locking bracket to rotate relative to the side supports. When a force is applied to the handle on the locking bracket, the force overcomes the torsion spring, causing the locking bracket to rotate relative to the side support. Since the pair of locking brackets are joined through a connecting rod, the rotation of either locking bracket causes a simultaneous rotation in the other locking bracket. Therefore, by moving one locking bracket to its unlocked position, the other locking bracket is synchronously moved to its unlocked position via the connecting rod, to enable the user to release the cross bar of the table leg from the receiving notches.

In another feature of the invention, a locking collar is connected to the folding plate such that when the table leg is in its folded position, the locking collar interacts with the table leg to securely hold the leg in its folded position.

Various other features, objects, and advantages of the invention will be made apparent from the following detailed description and the drawings.

BRIEF DESCRIPTION OF THE SEVERAL VIEWS OF THE DRAWINGS

The drawings illustrate the best mode presently contemplated of carrying out the invention.

In the drawings:

FIG. 1 is a side elevation view of a table having a pair of folding table legs incorporating the folding apparatus of the invention;

FIG. 2 is a partial sectional view of the folding table leg apparatus taken along line 2—2 of FIG. 1 including a portion of the table leg in its extended position;

FIG. 3 is a side elevation view of the folding table leg apparatus with reference to line 3—3 of FIG. 2, including a portion of the table leg in its extended position;

FIG. 4 is a sectional view taken along line 4—4 of FIG. 3, showing the table leg in section and showing the bottom plan view of the folding table leg apparatus;

FIG. 5 is a side elevation view of the folding table leg apparatus similar to FIG. 3, showing the table leg in its folded position;

FIG. 6 is a bottom plan view of the folding table leg apparatus similar to FIG. 4, showing the table leg in its folded position; and FIG. 7 is a sectional view taken along line 7—7 of FIG. 6 showing the interaction between the locking collar and table leg.

DETAILED DESCRIPTION OF THE INVENTION

A table incorporating the features of the invention is shown in FIG. 1 and is generally referred to by reference numeral 10. The table 10 consists of a table top 12, a pair of table legs 14 that support the table top 12, and a pair of folding apparatus generally referred to by reference numeral 16. Each of the folding apparatus 16 permits the respective table leg 14 to move from an extended position shown in FIG. 1 to the folded position shown in phantom in FIG. 1, as indicated by the movement arrows 18. When the table legs 14 are each in the folded position, the table 10 becomes a relatively flat, compact structure to facilitate storage and handling.

Each of the table legs 14 includes a base 20 at its lower end and a cross bar 21 (FIG. 6) at its upper end, which are both positioned perpendicular to a vertical portion 22. The vertical portion 22 of each table leg 14 extends between the floor and the folding apparatus 16 to support the table top 12 when the table leg 14 is in its extended position, as shown in FIG. 1. Both the base 20 and cross bar 21 can be secured to the vertical portion 22 by any conventional method of joining metal, such as welding.

FIGS. 2–6 show the folding apparatus 16 of the invention, which will now be described in detail. Referring first to FIGS. 2–4, the folding apparatus 16 includes a pair of independent side support brackets 24, each of which are securely connected to underside 26 of the table top 12 by a pair of connectors 28, such as but not limited to conventional wood screws. The pair of side support brackets 24 are connected to the underside 26 of the table top 12 such that they are parallel to each other and are disposed on opposite sides of the table leg 14 as shown in FIG. 2. The side support brackets 24 extend along a longitudinal axis parallel to the longitudinal axis of the table top 12 and include an integrally connected horizontal portion 30 and vertical portion 32, such that the support brackets 24 have a generally L-shaped configuration. As can be understood in the figures, the vertical portion 32 of each side support bracket 24 extends perpendicularly away from the underside 26 of the table top 12 and provides a secure surface for mounting the remaining components of the folding apparatus 16.

The table leg 14 is pivotally connected between the fixed side support brackets 24 by a folding plate 34 and a hinge bracket 36 to permit movement of the table leg 14 between its extended and folded positions. The folding plate 34 is a generally triangular shaped member having its narrow, first end 38 pivotally connected along a lower leg pivot axis 39 to vertical portion 22 of table leg 14. The wider, second end 40 of the folding plate 34 is pivotally connected to each of the side support brackets 24 (FIG. 4) along a folding plate pivot axis 41.

The folding plate 34 consists of a generally planar top portion 42 and a pair of side flanges 44, each of which extend downwardly from the outer edges of the top portion 42. As can best be seen in FIG. 4, the side flanges 44 extend past the second end 40 of the folding plate 34 to create a pair of mounting tabs 46, each of which is joined to the vertical portion 32 of one of the side support bracket 24 by a pivot pin connector 48. Each of the pivot pin connectors 48 includes an expanded head on each end of a shaft that passes through aligned openings in both the mounting tab 46 and the side support bracket 24. The pair of pivot pin connectors 48 are aligned with each other and allow the folding plate 34 to pivot about the folding plate pivot axis 41 defined by the pivot pin connectors 48 relative to the fixed side support brackets 24. In the preferred embodiment of the invention, the folding plate 34 is constructed of ¼ inch aluminum, such that the folding plate 34 has the required stiffness and strength to help support the table 10.

As previously described, the first end 38 of the folding plate 34 is pivotally connected to the table leg 14 along lower leg pivot axis 39. In particular, each of the side flanges 44 of the folding plate 34 extend outward past the lower edge of the top portion 42, which is formed with a notch 49 to accommodate the vertical portion 22 of leg 14 when the leg 14 is in its extended position. The lower extensions of the side flanges 44 define a second pair of mounting tabs 50, as can best be seen in FIG. 4. A pivot pin 51 extends through aligned openings in the vertical portion 22 of table leg 14 and mounting tabs 50 to define the lower leg pivot axis 39. The pivot pin 51 includes a shaft portion 52 which passes through the openings in the table leg 14 and in each of the mounting tabs 50. An expanded head 53 on each end of the shaft 52 holds the pivot pin 51 in place while permitting pivotal movement between the table leg 14 and the folding plate 34 about the lower leg pivot axis 39.

The curved configuration of the notch 49 in the lower edge of the top portion 42 of folding plate 34 creates the required clearance needed to permit of the table leg 14 to move from the extended position (FIG. 4) to the folded position (FIG. 6) without contact between the table leg 14 and the top portion 42. As can best be understood in FIGS. 2 and 6, the pivot pin 51, and thus the lower leg pivot axis 39, passes through the table leg 14 at a location longitudinally spaced from upper end 55 of the vertical portion 22 of leg 14.

Referring to FIG. 3, the folding plate 34 is angularly disposed between the side support brackets 24 and the vertical portion 22 when the table leg 14 is in its extended position. The folding plate 34 thus provides additional support for the table top 12 when the table leg 14 is in its extended position.

As noted previously, the hinge bracket 36 provides a second pivotal connection between the pair of side support brackets 24 and the table leg 14. As shown in FIG. 4, the hinge bracket 36 consists of a pair of parallel pivot arms 54 that are joined to each other at one end by a transverse member 56 such that the hinge bracket 36 forms a general C-shape. The pivot arms 54 are each pivotally connected to one of the side support brackets 24 by a pivot pin connector 58. Each of the pivot pin connectors 58 includes an expanded head 59 on each end of a shaft that passes through aligned openings in both the pivot arms 54 and the side support brackets 24. The pair of pivot pin connectors 58 are aligned with each other and allow the hinge bracket 36 to pivot about a hinge bracket pivot axis 60 (FIG. 4) relative to the side support brackets 24.

Pivot arms 54 are also rotatably connected to the cross bar 21 attached to the upper end 55 of the table leg 14. The rotatable connection between the pivot arms 54 and the cross bar 21 permits the table leg 14 to rotate about an upper leg pivot axis 61 (FIG. 4) relative to the hinge bracket 36. As can best be seen in FIG. 6, the cross bar 21 extends perpendicular to the longitudinal axis of the vertical portion 22 of table leg 14 and has an overall length slightly greater than the distance between the vertical portion 32 of the two side support brackets 24. A section of the cross bar 21 extends outwardly through openings in each pivot arm 54 to provide a pivot connection between cross bar 21 and each pivot arm 54. The length of the cross bar 21 extending past each pivot arm 54 will be referred to as an engagement portion 64 of the cross bar 21. Each of the pivot arms 54 extends past the cross bar 21 and includes a tab 62, the significance of which will be described below.

As can be seen in FIG. 5, when the table leg 14 is in its folded position, each of the tabs 62 contained on the pivot arms 54 is located further from the table top 12 than any other portion of the folding apparatus 16. In this manner, when a series of tables 10 are stacked one on top of another, the table top 12 of one table is engaged by the tabs 62 of the adjacent table to prevent the metal components of the folding apparatus 16 from scratching the table top 12. Preferably, each of the tabs 62 is provided with a rubber coating to further protect the table top 12 of the adjacent stacked tables.

The transverse member 56 of hinge bracket 36 includes a cradle 66 as shown in FIGS. 2 and 4, having a radius generally corresponding to the outer diameter of the vertical portion 22 of table leg 14. When the table leg 14 is in its folded position (FIG. 6), the vertical portion 22 rests in the cradle 66, such that transverse member 56 does not interfere with table leg 14 when folded.

As shown in FIGS. 3 and 5, the side support brackets 24 each include a receiving notch 68 formed in the vertical portion 32. The receiving notches 68 are positioned such that they receive the engagement portion 64 of the cross bar 21 when the table leg 14 is in its extended position, as can clearly be seen in FIG. 3. The engagement portions 64 of the cross bar 21 interact with the receiving notches 68 in the support brackets 24 to provide support for the table top 12 when the table legs 14 are extended.

The folding apparatus 16 permits the table leg 14 to move from the extended position of FIGS. 1–4 to the folded position of FIGS. 5–6, as follows. When the table leg 14 is moved as indicated by arrow 18 (FIG. 1), both the folding plate 34 and hinge bracket 36 pivot relative to the fixed pair of side support brackets 24, to provide a compound pivot action at the upper end of leg 14. As the table leg 14 begins to move to the folded position, the vertical portion 22 rotates relative to folding plate 34 about the lower leg pivot axis 39 passing through the pivot pin 51. At the same time, the table leg 14 pivots about upper leg pivot axis 61 passing through the cross bar 21 and pivot arms 54 pivot about pivot axis 60. Unlike a conventional folding table leg that only pivots about the upper end of the leg towards the interior of the table, the table leg 14 of the present invention rotates and translates simultaneously.

As the pair of pivot arms 54 rotate about pivot axis 60 defined by pivot pin connectors 58, the upper end 55 of the vertical leg 14 connected to the cross bar 21 translates outwardly (left in FIGS. 3 and 4) toward the outer edge of the table. Initially, the cross bar 21 moves downwardly away from the underside 26 of the table top 12 as the pivot arms 54 rotate along path 54*a* (FIG. 3).

Once the pivot arms 54 become perpendicular with the table top 12, further rotation of the pivot arms 54 causes the cross bar 21 to move upwardly toward the underside 26 of the table top 12. During this entire movement along path 54*a*, the upper end 55 of the table leg 14 continues to move outwardly away from the folding apparatus 16 and toward the outer edge of the table 10.

During movement from the extended position to the folded position, the table leg 14 also rotates about the lower leg pivot axis 39 passing through the pivot rod 51. As the table leg 14 rotates about the lower leg pivot axis 39, the first end 38 of the folding plate 34 moves toward the table top 12 along path 34*a* until it reaches the position shown in FIG. 5.

A primary benefit of the folding apparatus 16, including the folding plate 34 and hinge bracket 36, is that, in the folded position, the upper end 55 of table leg 14 is located closer to the outer edge of the table top than a typical folding leg in which the table leg pivots about the upper end. Thus, since the table legs 14 extend a distance less than the entire length of the table leg 14 toward the interior of the table top, the pair of folding apparatus 16, shown in FIG. 1, can be attached to the table top closer together than conventional apparatus for table legs having a comparable length. The mechanical linkage construction of the invention is a space saving feature that can be easily adapted for use on smaller tabletops, or in instances where a plurality of folding legs are used on a long table. In order to achieve a similar beneficial result, the conventional folding table would require that the table leg be hinged at the end of the table and fold inward, an option that would severely reduce the flexibility and feasibility of the folding table.

The folding apparatus 16 further includes a locking mechanism, FIG. 6, generally referred to at 70. The locking mechanism 70 includes a connecting rod 72 and a pair of locking brackets 74. The connecting rod 72 extends between and through the vertical portion 32 of each side support bracket 24 and is rotatably supported thereby. A locking bracket 74 is securely connected near each end of the connecting rod 72. The locking brackets 74 are located on the opposite sides of the vertical portion 32 of support brackets 24 from the table leg 14, such that the locking brackets 74 are located outside of the area defined by the vertical portions 32 of the pair of side support brackets 24. Referring now to FIG. 5, locking brackets 74 each include a handle 76, a cam surface 78, a locking surface 80 and a stop surface 82. The locking brackets 74 are securely connected to each end of the connecting rod 72, such that rotation of either of the brackets 74 in the direction shown by arrow 83 causes a simultaneous rotation in the other locking bracket 74.

When the table leg 14 is in the extended position, FIGS. 3 and 4, each of the locking brackets 74 is held in the locked position thereshown by a torsion spring 84. Referring to FIG. 3, torsion spring 84 is positioned such that it exerts a rotational locking force on the locking bracket 74 in a clockwise direction about the connecting rod 72. The rotational locking force generated by the torsion spring 84 causes each of the locking brackets 74 to cover the receiving notches 68. This clockwise locking force causes the locking surface 80 of each locking bracket 74 to be forced into frictional contact with the engagement portion 64 of the cross bar 21, thereby holding the engagement portion 64 within the receiving notch 68.

To release the engagement portion 64 of the cross bar 21 from the receiving notch 68, the user depresses handle 76 to rotate the locking bracket 74 about connecting rod 72 in a counterclockwise direction as indicated by arrow 83 in FIG. 5. To cause rotation of the locking bracket 74 from the locked position, the user must exert a force great enough to overcome the locking force provided by torsion spring 84. Since both locking brackets 74 are joined by connecting rod 72, rotation of one locking bracket 74 results in simultaneous rotation of the second locking bracket 74. In this manner, the user can release both locking brackets 74 by depressing either of the handles 76.

Once the locking brackets 74 are rotated about connecting rod 72 to the unlocked position, the locking surface 80 is no longer in contact with the engagement portion 64 of the cross bar 21. The user can then provide a force on the table leg 14 in the direction of arrow 18 in FIG. 1, to move the table leg 14 to the folded position as previously discussed.

When the table leg 14 is in the folded position, FIG. 5, the torsion spring 84 causes each of the locking brackets 74 to be normally disposed in the locked position to cover the receiving notches 68 in the side supports 24. As the table leg 14 is moved from the folded position to the extended position, the downward movement of the cross bar 21 causes the engagement portions 64 of the cross bar 21 to contact the cam surface 78 of each locking bracket 74. As the table leg 14 continues to move toward the extended position, the downward and rightward movement of the engagement portions 64 of the cross bar 21 causes the engagement portions 64 to interact with the arcuate cam surface 78 on each locking bracket 74 to cause each of the locking brackets 74 to rotate away from the locked position, as shown by arrow 83 in FIG. 5. The locking bracket 74 continues to rotate against the locking force exerted by torsion spring 84 until the engagement portion 64 of the cross bar 21 reaches the rockered edge 85 where the cam surface 78 meets the locking surface 80.

Once the locking bracket 74 rotates past the rockered edge 85, the engagement portions 64 of the cross bar 21 will be positioned in the receiving notches 68 and the torsion spring 84 will cause the locking bracket 74 to rotate back to the locked position shown in FIG. 3. In this position, the locking surface 80 of the locking bracket 74 securely retains the engagement portions 64 of the cross bar 21 in the receiving notches 68 to positively maintain leg 14 in its extended position. In this manner, the pair of locking brackets 74 act to securely hold the table leg 14 in its extended position, while allowing the user to selectively depress either handle 76 to release the table leg 14 from its extended position.

In addition, each of the locking brackets 74 includes a stop surface 82 which restricts the amount of clockwise rotation induced by the torsion spring 84. As can be seen in FIG. 5, the stop surface 82 contacts the horizontal portion 30 of side support bracket 24 to prevent the locking bracket 74 from rotating any further in the clockwise direction due to the locking force from torsion spring 84.

The folding apparatus 16 preferably includes a locking collar 86 securely mounted to the top portion 42 of the folding plate 34 by a screw connector 88 (FIG. 4). Locking collar 86 is preferably a resilient member having a pair of flexible side arms 90 which are used to retain the table leg 14 in the folded position. As shown in FIG. 3, the side arms 90 interact with the table leg 14 to hold the table leg 14 in a completely folded position. In this manner, the locking collar 86 prevents table leg 14 from becoming partially extended during storage. To move the table leg 14 from the folded position to the extended position, force must be exerted on table leg 14 to cause the side arms to deflect outward away from the table leg 14. The locking collar 86 includes a pair of molded bosses 92 that are received in the top portion 42 to further hold the locking collar 86 in place on the top portion 42.

Various other alternative and embodiments are contemplated as being within the scope of the following claims particularly pointing out and distinctly claiming the subject matter regarded as the invention.

We claim:

1. A folding table leg apparatus for a table having a table top, the folding table leg apparatus comprising:

a table leg having an upper end and a lower end, the table leg being movable between an extended position and a folded position;

a pair of side supports connectable to the underside of the table top, each side support having a receiving notch formed therein, wherein a first one of the side supports is positioned on one side of the table leg and a second one of the side supports is positioned on an opposite side of the table leg from the first side support;

a cross bar connected to the upper end of the table leg and extending perpendicular to the table leg, the cross bar being received in the receiving notches when the table leg is in the extended position;

a hinge bracket pivotally connected to the cross bar and to each of the side supports; and a folding member having a first end and a second end, the first end of the folding member being pivotally connected to the table leg and the second end of the folding member being pivotally connected to each of the side supports;

wherein the hinge bracket and the folding member permit the table leg to move between the extended and the folded positions.

2. The folding table leg apparatus of claim 1 wherein the hinge bracket includes a pair of parallel pivot arms connected by a transverse member, each of the pivot arms being positioned on opposite sides of the table leg and being connected between the cross bar and one of the side supports, wherein the transverse member extends between the pair of side supports.

3. A folding table leg apparatus for a table having a table top, the folding table leg apparatus comprising:

a table leg having an upper end and a lower end, the table leg being movable between an extended position and a folded position;

a pair of side supports connectable to the underside of the table top, each side support having a receiving notch formed therein;

a cross bar connected to the upper end of the table leg and extending perpendicular to the table leg, the cross bar being received in the receiving notches when the table leg is in the extended position;

a hinge bracket pivotally connected to the cross bar and to each of the side supports, the hinge bracket including a pair of parallel pivot arms connected by a transverse member, each of the pivot arms being positioned on opposite sides of the table leg and being connected between the cross bar and one of the side supports, each of the pivot arms including a tab, the tab being located further from the table top than the rest of the folding table leg apparatus when the table leg is in the folded position; and a folding member pivotally connected to the table leg and each of the side supports;

wherein the hinge bracket and the folding member permit the table leg to move between the extended and the folded positions.

4. The folding table leg apparatus of claim 2 wherein the transverse member includes a cradle, wherein the cradle receives the table leg when the table leg is in the folded position.

5. The folding table leg apparatus of claim 1 further comprising a pair of locking brackets, each locking bracket being connected to one of the side supports, the locking brackets being positioned to securely hold the cross bar in the receiving notches when the table leg is in the extended position.

6. The folding table leg apparatus of claim 5 wherein the locking brackets each include a handle portion which may be depressed to rotate the locking brackets.

7. The folding table leg apparatus of claim 5 wherein the locking brackets each include a cam surface which contacts the cross bar when the table leg is moved from the folded position to the extended position, the cam surface causing the locking bracket to rotate to allow the cross bar to enter the receiving notches.

8. The folding table leg apparatus of claim 5 further comprising a torsion spring connected between each locking bracket and the side support, such that the torsion spring biases the locking bracket to cover the receiving notch.

9. The folding table leg apparatus of claim 5 further comprising a connecting rod extending between the pair of side supports and being joined to each locking bracket such that the rotation of one locking bracket rotates the connecting rod, which in turn rotates the second locking bracket.

10. The folding table leg apparatus of claim 1 further comprising a locking collar securely connected to the folding member to retain the table leg in the folded position.

11. A folding table leg apparatus adapted for use with a table having a table top, the folding table leg apparatus comprising:

a table leg having an upper end and a lower end, the table leg being movable between an extended position and a folded position;

a cross bar connected to the upper end of the table leg and extending perpendicular to the table leg;

support structure adapted for connection to the table top, wherein the support structure defines an engagement surface adapted for engagement with the underside of the table top and includes a receiving notch formed therein for receiving the cross bar when the leg is in the extended position; and a locking mechanism for securing the cross bar in the receiving notch, wherein the locking mechanism includes a pair of locking brackets connected to a connecting rod, wherein the connecting rod extends between the locking brackets and is rotatably supported by the support structure, and wherein rotation of the connecting rod by movement of one of the locking brackets causes each of the locking brackets to rotate, wherein the connecting rod is located between the table leg and the support structure engagement surface when the table leg is in the folded position.

12. The folding table leg apparatus of claim 11 further comprising a pair of torsion springs, each of the torsion springs being positioned between one of the locking brackets and the support structure to bias the locking brackets into a locking position to cover the receiving notch.

13. A folding table leg apparatus for a table having a table top, the folding table leg apparatus comprising:

a table leg having an upper end and a lower end, the table leg being movable between an extended position and a folded position;

a cross bar connected to the upper end of the table leg and extending perpendicular to the table leg;

a pair of side supports connectable to the underside of the table top, each side support having a receiving notch formed therein for receiving the cross bar when the leg is in the extended position;

a folding plate having a first and a second end, the first end of the folding plate being pivotally connected to the table leg and the second end of the folding plate being pivotally connected to each of the side supports; and a locking mechanism for securing the cross bar in the receiving notches, the locking mechanism including a pair of locking brackets connected to a connecting rod, the connecting rod extending between and being rotatably supported by the pair of side supports, such that rotation of the connecting rod causes each of the locking brackets to rotate.

14. The folding table leg apparatus of claim 13 further comprising a hinge bracket having a pair of parallel pivot arms and a transverse member extending between the pivot arms, each of the pivot arms being positioned on opposite sides of the table leg and pivotally connected to one of the side supports and the cross bar.

15. The folding table leg apparatus of claim 11 wherein each of the locking brackets includes a handle portion such that depression of the handle portion on either of the locking brackets rotates both of the locking brackets.

16. The folding table leg apparatus of claim 11 wherein the locking brackets each include a cam surface which contacts the cross bar when the table leg is moved from the folded position to the extended position, wherein interaction between the cross bar and the cam surface causes the locking bracket to rotate away from the receiving notch to allow the cross bar to enter the receiving notch.

17. A folding table comprising:

a table top;

a pair of table legs having an upper and a lower end, the table legs being movable between an extended position and a folded position;

a pair of folding table leg apparatus, each apparatus associated with one of the table legs, each apparatus comprising:

a pair of side supports connectable to the underside of the table top, each side support having a receiving notch formed therein;

a cross bar connected to the upper end of the table leg and extending perpendicular to the table leg, the cross bar being received in the receiving notches when the table leg is in the extended position;

a hinge bracket including a pair of parallel pivot arms connected by a transverse member, each of the pivot arms being positioned on opposite sides of the table leg and being pivotally connected to the cross bar and one of the side supports;

a folding plate having a first and a second end, the first end of the folding plate being pivotally connected to the table leg and the second end of the folding plate being pivotally connected to each of the side supports; and a locking mechanism for securing the cross bar in the receiving notches, the locking mechanism having a pair of locking brackets connected to a connecting rod and biased into a locked position, the connecting rod extending between and rotatably supported by the pair of side supports, wherein rotation of the connecting rod causes both of the locking brackets to rotate from the locked position.

18. The folding table leg apparatus of claim 17 wherein the locking brackets each include a cam surface which contacts the cross bar when the table leg is moved from the folded to the extended position, the cam surface causing the locking bracket to rotate away from the receiving notch to allow the cross bar to enter the receiving notch.

19. The folding table leg apparatus of claim 17 wherein each of the pivot arms includes a tab, the tab being located further from the table top than the rest of the folding table leg apparatus when the table leg is in the folded position.

20. The folding table leg apparatus of claim 17 wherein the transverse member includes an arcuate cradle, wherein the cradle receives the table leg when the table leg is in the folded position.

21. The folding table leg apparatus of claim 17 further comprising a torsion spring connected between the locking bracket and the side support, such that the torsion spring biases the locking bracket to cover the receiving notch.

22. In a leg mounting assembly for a table including a table top and at least one leg, the leg defining an upper end and a lower end and including a support structure adapted to be secured to the table and a folding mechanism interconnected between the leg and the support structure for providing movement of the leg between an extended position and a folded position, the improvement comprising:

a folding plate having a first end connected to the support structure and a second end interconnected with the leg for movement between a first position when the leg is in its extended position and a second position when the leg is in its folded position, and a locking collar connected to the folding plate between the first end and the second end, wherein the locking collar is releasably engageable with the leg when the leg is in its folded position and the folding plate is in its second position for preventing movement of the leg away from its folded position, and wherein the leg is disengageable from the locking collar for enabling the leg to be moved to its extended position and the folding plate to be moved to its first position, wherein when the folding plate is moved to its first position, the locking collar moves away from the table top along with the folding plate.

* * * * *